US007649320B2

(12) United States Patent
Küpper et al.

(10) Patent No.: US 7,649,320 B2
(45) Date of Patent: Jan. 19, 2010

(54) LAMP WITH IMPROVED LAMP PROFILE

(75) Inventors: Lukas Küpper, Aachen (DE); Michael Haacke, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 130 days.

(21) Appl. No.: 10/598,557

(22) PCT Filed: Mar. 1, 2005

(86) PCT No.: PCT/IB2005/050731

§ 371 (c)(1),
(2), (4) Date: Jun. 25, 2007

(87) PCT Pub. No.: WO2005/086571

PCT Pub. Date: Sep. 23, 2005

(65) Prior Publication Data

US 2007/0278926 A1 Dec. 6, 2007

(30) Foreign Application Priority Data

Mar. 9, 2004 (EP) ..... 04100953

(51) Int. Cl.
*H01J 17/20* (2006.01)

(52) U.S. Cl. ..... 313/637; 313/567

(58) Field of Classification Search ..... 313/627–643, 313/567

See application file for complete search history.

(56) References Cited

U.S. PATENT DOCUMENTS

| | | | | |
|---|---|---|---|---|
| 6,815,889 | B2 * | 11/2004 | Haacke et al. | 313/573 |
| 2002/0027421 | A1 * | 3/2002 | Kaneko et al. | 313/637 |
| 2003/0178942 | A1 * | 9/2003 | Born et al. | 313/637 |

FOREIGN PATENT DOCUMENTS

JP 2003068248 * 7/2003

* cited by examiner

*Primary Examiner*—Joseph L Williams

(57) ABSTRACT

A lamp, containing ≦100 ppm Hg, includes a burner chamber having an axis, the axis having a section ≧0.05 mm. The burner chamber has a recess oriented toward a light arc produced in the burning chamber to suppress arc curvature. The lamp has an arc-luminescence profile of luminescence (measured in cd/m$^2$)/mm with an average slope over that section which is ≧|300,000,000| (cd/m$^2$)/mm. Preferably, the profile maximum value is ≧90,000,000 cd/m$^2$. In one embodiment, the arc-making device includes two electrodes disposed for producing the light arc across their two tips, the depth of the recess being sufficiently small so as not to extend between the two tips.

24 Claims, 2 Drawing Sheets

LAMP WITH IMPROVED LAMP PROFILE

The present invention relates to a lamp with an improved lamp profile, in particular an Hg-free lamp with an improved arc luminescence profile.

In today's lamps, especially HID (high intensity discharge) lamps which are used in motor vehicles, the so-called light cut-off plays an important role for the characterization of the lamp. In recent years, the demand on the sharpness of the light cut-off have increased, since in the case that the lamp is used in a vehicle head- or rear light, other approaching vehicles that travel on the other side of the road must not be blinded or dazzled by the light; however, the illuminance of the road that lies ahead must be as good and clear as possible.

Furthermore, according to environmental awareness, it is nowadays demanded that lamps in motor vehicles should have a small content of Hg (Mercury) as possible and preferably contain no Hg whatsoever.

Therefore it is an object to provide a lamp that has an improved light cut-off while still meeting the demands in the field.

This object is achieved by a lamp, preferably a Hg-free Lamp whereby the lamp has an arc-luminescence profile of Luminescence (cd/m$^2$)/mm with at least one section, in which said at least one section is at least ≧0.05 mm and ≦0.5 mm, and the slope in Luminescence/mm for said at least one section is ≧|300,000,000| (cd/m$^2$)/mm. Most desirable the slope in Luminescence/mm for each of said sections is between ≧|300,000,000| (cd/m$^2$)/mm and ≦|1,300,000,000| (cd/m$^2$)/mm. Most desirable the lamp has at least two sections, who are at least ≧0.05 mm and ≦0.5 mm, and the slope in Luminescence/mm for each of said sections is ≧|300,000,000| (cd/m$^2$)/mm.

Due to the sharp increase and/or decrease in the arc-luminescence profile, a sharp light cut-off can be achieved, while the lamp still has a good overall lighting performance.

Hg-free in the sense of the present application means that the lamp contains ≦100 ppm Hg, preferably ≦50 ppm and yet more preferred between ≧0 ppm and ≦10 ppm Hg.

In a preferred embodiment of the present invention at least one of said sections is ≧0.1 mm and ≦0.45 mm, more preferred ≧0.15 mm and ≦0.40 mm, most preferred ≧0.2 mm and ≦0.35 mm.

In a further preferred embodiment of the present invention is at least for one of said sections the slope in luminescence/mm is ≧|325,000,000| (cd/m$^2$)/mm, more preferred ≧|350,000,000| (cd/m$^2$)/mm, further more preferred ≧|375,000,000| (cd/m$^2$)/mm and most preferred ≧|400,000,000| (cd/m$^2$)/mm In a preferred embodiment of the present invention the lamp has an arc-luminescence profile with a maximum value of luminescence of ≧90,000,000 cd/m$^2$, preferred ≧95,000,000 cd/m$^2$, more preferred ≧100,000,000 cd/m$^2$, further more preferred ≧105,000,000 cd/m$^2$, yet more preferred ≧110,000,000 cd/m$^2$ and most preferred ≧115,000,000 cd/m$^2$. Most desirable the maximum value of Luminescence is between ≧90,000,000 cd/m$^2$ and ≦190,000,000 cd/m$^2$. By this way a lamp with a high lighting performance can be achieved easily.

In a further preferred embodiment of the present invention the lamp has in a reflective headlight an illuminance at 75L and/or 75R of ≧13 lux, more preferred of ≧13.5 lux, yet more preferred of ≧14 lux, further more preferred of ≧14.5 lux and most preferred of ≧15 lux and/or an illuminance at 50L and/or 50R of ≧20 lux, more preferred of ≧22 lux, yet more preferred of ≧24 lux, further more preferred of ≧26 lux and most preferred of ≧27 lux and/or an illuminance at 50V of ≧16 lux, more preferred of ≧18 lux, yet more preferred of ≧20 lux, further more preferred of ≧22 lux and most preferred of ≧24 lux. Most desirable, the illuminance at 75L and/or 75R is between ≧13 lux and ≦30 lux, the illuminance at 50L and/or 50R is between ≧20 lux and ≦40 lux and the illuminance at 50V is between ≧16 lux and ≦50 lux, This allows a better lighting performance of the lamp e.g. in a motor vehicle.

In a further preferred embodiment of the present invention the lamp has in a projective headlight an illuminance at 75L and/or 75R of ≧19 lux, more preferred of ≧20 lux, yet more preferred of ≧21 lux, further more preferred of ≧22 lux and most preferred of ≧23 lux and/or an illuminance at 50L and/or 50R of ≧21.8 lux, more preferred of ≧22 lux, yet more preferred of ≧22.5 lux, further more preferred of ≧22.8 lux and most preferred of ≧23 lux and/or an illuminance at 50V of ≧14 lux, more preferred of ≧15 lux, yet more preferred of ≧16 lux, further more preferred of ≧17 lux and most preferred of ≧19 lux. Most desirable, the illuminance at 75L and/or 75R is between ≧19 lux and ≦40 lux, the illuminance at 50L and/or 50R is between ≧21.8 lux and ≦40 lux and the illuminance at 50V is between ≧14 lux and ≦50 lux. By using such a lamp, a better lighting performance of the lamp e.g. in a motor vehicle can be obtained easily.

In a further preferred embodiment of the present invention the lamp has an arc curvature with a curvature of ≦25%, more preferred ≦20%, preferred ≦15%, preferred ≦10%, and most preferred between ≧0 and ≦5%.

Curvature is defined within the present invention as the vertical extension of the light arc compared with the longitudinal length. An arc light has the longitudinal length A and a lateral extension of B. Then the Curvature as defined within the present invention is simply calculated by the formula:

$$\frac{B}{A} * 100.$$

By using a lamp with such a curvature, a better performance of the lamp, including a sharp light cut-off can be obtained, while the illuminance of the lamp still meets the standards in the field.

In a further preferred embodiment of the present invention the lamp is a HID lamp.

In a further preferred embodiment of the present invention the lamp is a quartz lamp.

Further data and information as well as advantages and features of the present invention can be obtained out of the following tables I to III.

Table I shows the luminescence profile of a lamp according to the present invention compared with a lamp of the prior art.

TABLE I

| Comparative Example | | Inventive Example | |
|---|---|---|---|
| mm | Luminescence (cd/m$^2$) | mm | Luminescence (cd/m$^2$) |
| 0.00 | 1.378.860 | 0.00 | 1.978.370 |
| 0.02 | 1.616.700 | 0.02 | 2.341.480 |
| 0.05 | 1.523.700 | 0.05 | 2.884.910 |
| 0.07 | 2.624.040 | 0.07 | 2.673.570 |
| 0.10 | 3.644.180 | 0.10 | 2.435.770 |
| 0.12 | 3.828.070 | 0.12 | 2.649.250 |
| 0.15 | 4.847.330 | 0.15 | 3.406.870 |
| 0.17 | 7.392.990 | 0.17 | 4.005.030 |
| 0.19 | 10.778.000 | 0.19 | 4.966.520 |
| 0.22 | 12.981.600 | 0.22 | 5.331.650 |

TABLE I-continued

| Comparative Example | | Inventive Example | |
|---|---|---|---|
| mm | Luminescence (cd/m$^2$) | mm | Luminescence (cd/m$^2$) |
| 0.24 | 16.793.200 | 0.24 | 5.974.610 |
| 0.27 | 23.498.400 | 0.27 | 6.937.750 |
| 0.29 | 29.541.100 | 0.29 | 8.110.670 |
| 0.32 | 36.232.900 | 0.32 | 10.040.300 |
| 0.34 | 42.250.100 | 0.34 | 14.033.800 |
| 0.36 | 49.395.200 | 0.36 | 18.848.400 |
| 0.39 | 55.984.300 | 0.39 | 27.318.700 |
| 0.41 | 61.631.900 | 0.41 | 39.528.000 |
| 0.44 | 66.172.200 | 0.44 | 56.331.000 |
| 0.46 | 67.821.300 | 0.46 | 72.987.400 |
| 0.49 | 71.938.800 | 0.49 | 88.321.300 |
| 0.51 | 80.189.400 | 0.51 | 102.763.000 |
| 0.53 | 80.547.200 | 0.53 | 109.357.000 |
| 0.56 | 83.878.500 | 0.56 | 115.161.000 |
| 0.59 | 86.411.100 | 0.59 | 117.145.000 |
| 0.62 | 88.633.500 | 0.62 | 112.751.000 |
| 0.64 | 76.484.900 | 0.64 | 113.115.000 |
| 0.67 | 82.923.300 | 0.67 | 115.332.000 |
| 0.69 | 78.017.500 | 0.69 | 109.583.000 |
| 0.71 | 74.787.700 | 0.71 | 108.015.000 |
| 0.74 | 66.929.500 | 0.74 | 99.599.400 |
| 0.76 | 59.819.500 | 0.76 | 85.798.500 |
| 0.79 | 51.210.700 | 0.79 | 73.158.400 |
| 0.81 | 41.505.900 | 0.81 | 65.484.600 |
| 0.84 | 33.068.000 | 0.84 | 54.826.000 |
| 0.86 | 25.198.300 | 0.86 | 46.671.500 |
| 0.88 | 20.179.100 | 0.88 | 38.301.300 |
| 0.91 | 15.067.100 | 0.91 | 30.745.100 |
| 0.93 | 11.516.300 | 0.93 | 24.098.000 |
| 0.96 | 10.605.900 | 0.96 | 19.465.200 |
| 0.98 | 8.585.140 | 0.98 | 15.697.200 |
| 1.01 | 7.379.140 | 1.01 | 12.895.700 |
| 1.03 | 6.259.180 | 1.03 | 10.649.200 |
| 1.05 | 6.859.630 | 1.05 | 9.403.960 |
| 1.08 | 6.600.420 | 1.08 | 8.551.760 |
| 1.10 | 6.794.910 | 1.10 | 8.988.460 |
| 1.13 | 5.594.450 | 1.13 | 8.130.910 |
| 1.15 | 5.578.640 | 1.15 | 7.582.500 |
| 1.18 | 5.788.820 | 1.18 | 7.604.980 |

Table I shows the luminescence profile of a lamp according to the present invention compared with a lamp of the prior art. As can be seen in Table I and FIG. 1, the increase and decrease of the luminescence/mm of a lamp according to the present invention is much sharper than compared to a lamp of the prior art. Therefore, a much sharper light cut-off can be obtained. Furthermore, the overall maximum luminescence of a lamp according to the present invention is much higher than with a lamp of the prior art.

Table II shows the illuminance of a lamp according to the present invention compared with a lamp of the prior art in a reflective headlight.

TABLE II

| Reflective Headlight | Measurement method | 75L and/or 75R | 50L and/or 50R | 50V |
|---|---|---|---|---|
| Comparative | DIN R98 | 12.77 | 19.3 | 14.99 |
| Inventive | DIN R98 | 15.5 | 27.1 | 24.3 |

As can be seen, the illuminance of a lamp according to the present invention in the relevant areas of a lamp, being 75L and/or 75R, 50L and/or 50R and 50V is higher than with a lamp of the prior art. (A definition of 75L, 75R, 50L, 50R and 50V can be found in the DIN R 98).

Table III shows the illuminance of a lamp according to the present invention compared with a lamp of the prior art in a projective headlight.

TABLE III

| Projective headlight | Measurement method | 75L and/or 75R | 50L and/or 50R | 50V |
|---|---|---|---|---|
| Comparative | DIN R98 | 18.73 | 21.6 | 13.34 |
| Inventive | DIN R98 | 23.9 | 23.05 | 19.87 |

As can be seen, the illuminance of a lamp according to the present invention in the relevant areas of a lamp, being 75L and/or 75R, 50L and/or 50R and 50V is higher than with a lamp of the prior art in a projective headlight, too. (A definition of 75L, 75R, 50L, 50R and 50V can be found in the DIN R 98).

Further data, information, advantages and features of the present invention can be obtained out of the accompanying FIGS. 1 to 5.

Figure 1:
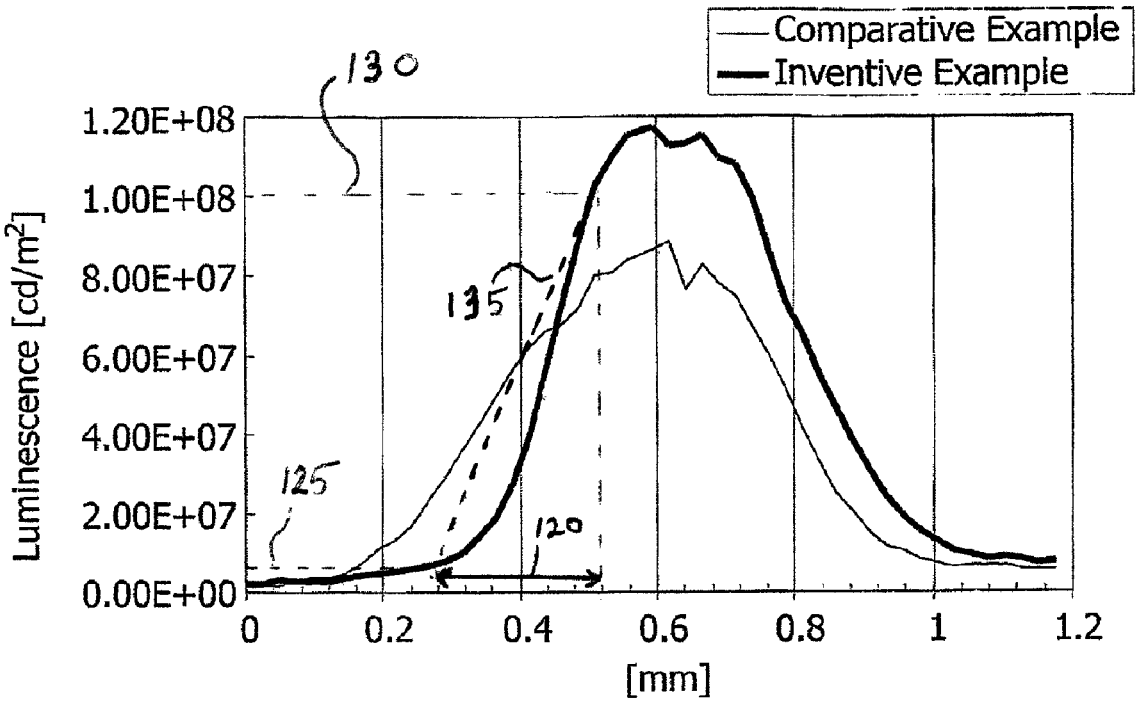
FIG. 1 shows the luminescence profile of a lamp according to the present invention compared with a lamp of the prior art.
Figure 2:
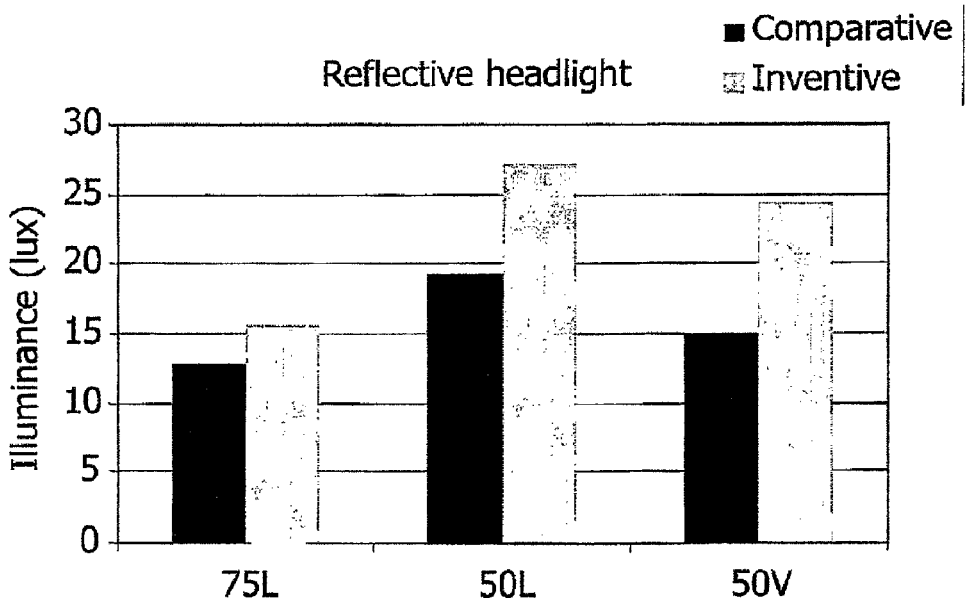
FIG. 2 shows the illuminance of a lamp according to the present invention compared with a lamp of the prior art in a reflective headlight.
Figure 3:
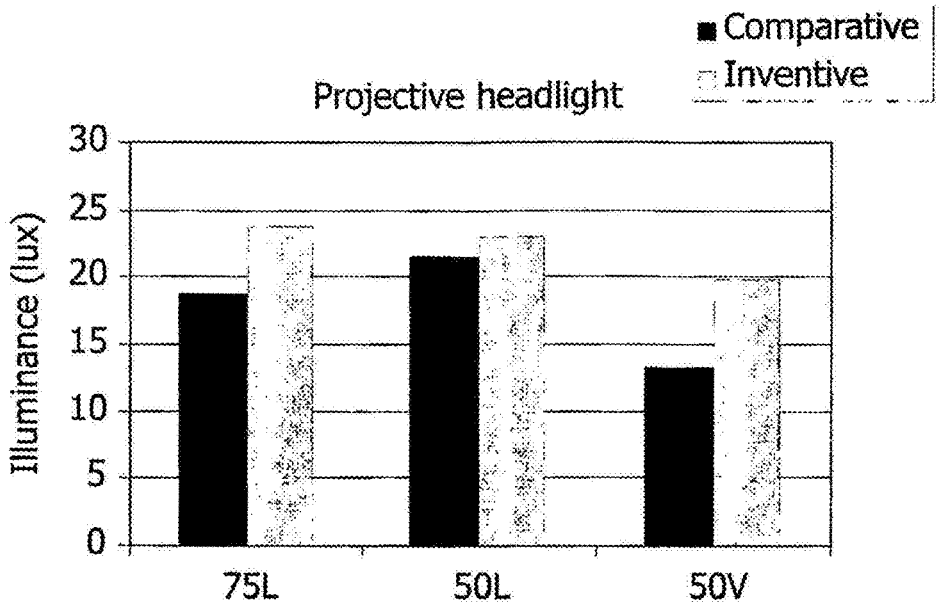
FIG. 3 shows the illuminance of a lamp according to the present invention compared with a lamp of the prior art in a projective headlight.

FIG. 1 shows the luminescence profile of a lamp according to the present invention compared with a lamp of the prior art. As can be seen in FIG. 1, the increase and decrease of the luminescence/mm of a lamp according to the present invention is much sharper than compared to a lamp of the prior art. Therefore, a much sharper light cut-off can be obtained. Furthermore, the overall maximum luminescence of a lamp according to the present invention is much higher than with a lamp of the prior art. Therefore, a better overall performance of the lamp can be achieved. This can also be seen in FIGS. 2 and 3, in which the illuminance of a lamp according to the present invention compared with a lamp of the prior art in a reflective (FIG. 2) and projective (FIG. 3) headlight is shown. As can be seen, the illuminance of a lamp according to the present invention in the relevant areas of a lamp, being 75L and/or 75R, 50L and/or 50R and 50V is higher than with a lamp of the prior art. (A definition of 75L, 75R, 50L, 50R and 50V can be found in the DIN R 98).

Referring again and in more detail to FIG. 1, the axis of the burner chamber of the lamp, which is discussed below in connection with FIG. 4, has a section 120 disposed between length values 0.28 and 0.52. Over the section 120, the inventive luminescence profile rises from a beginning luminescence 125 of 5E+06 to an ending luminescence 130 of 1E+08. The average slope over the section 120, as shown by a broken, slanted line 135, is (1E+08−5E+06)/(0.52−0.28) (cd/m$^{2)}$/mm which is ≈396,000,000 (cd/m$^{2)}$/mm.

Figure 4:
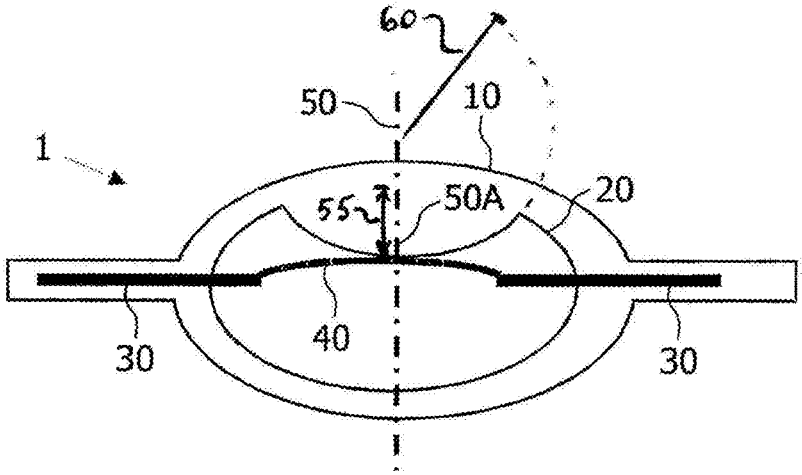
FIG. 4 shows a cross-sectional schematic view through a lamp according to one embodiment of the present invention.
Figure 5:
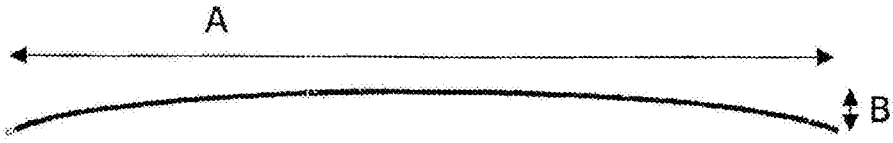
FIG. 5 shows a schematic enlarged view of the light arc of the lamp of FIG. 4.

FIG. 4 shows a cross-sectional schematic view through a lamp 1 according to one embodiment of the present invention. The lamp 1 comprises a lamp body 10, a burner chamber 20, two rods 30, between which a light arc 40 is formed, when the lamp 1 is running. FIG. 5 shows the curvature profile of the light arc of FIG. 4. Curvature in the sense of the present invention is measured by obtaining the lateral extension (indicated by "B") and comparing it with the longitudinal length (indicated by "A"). The curvature is then simply calculated by the formula:

$$\frac{B}{A} * 100.$$

According to this embodiment of the present invention and insofar preferred, the arc-luminescence profile of Luminescence (measured in cd/m$^2$)/mm is measured along section 50A of the axis 50.

It is preferred that the Curvature of the lamp should be as low as possible, preferred of ≦25%, more preferred ≦20%, preferred ≦15%, preferred ≦10%, and most preferred between ≧0% and ≦5%. This can be achieved by using a burner chamber 20 which is not entirely symmetric but formed with a recess on the upper side which is oriented towards the light arc. The preferred shape of the recess is spherical or cylindrical and has a radius 60 larger than 1 mm. The depth 55 of the recess, as indicated by the double-headed arrow, is smaller than the vertical distance between the electrodes and the inner wall of the burner chamber.

A lamp as described above can be used in various applications, amongst them:

shop lighting,
home lighting,
head lamps
accent lighting,
spot lighting,
theater lighting,
consumer TV applications,
fiber-optics applications,
car lighting, and
projection systems.

Measuring Methods:

The data presented within the presented invention were—unless otherwise indicated—collected using the DIN R98 (contained in the UNECE 1958 Agreement Concerning the Adoption of Uniform Technical Prescriptions and addenda).

Illuminance for the measurements of 75L and/or 75R, 50L and/or 50R and 50 V was measured with a Gonio-photometer measurement of the lamp in a head light using a V(λ) corrugated photo cell.

Luminescence in cd/m$^2$ was measured with a digital camera, which was V(λ) corrigated and calibrated. The data were collected using the high dynamic range camera LMK 98 and the LMK2000 software from TechnoTeam, Ilmenau, Germany. An automotive xenon high intensity discharge bulb according to this disclosure is mounted in a holder which fixes the burner device in a horizontal position in such a way that the axis of the burner is oriented perpendicular to the CCD-camera axis. Then the socket of the high intensity discharge bulb is connected to the electronic driver (ballast) which is powered by a 14V power supply. After switching on the power supply the light arc of the high intensity discharge bulb is burning in a stabilized mode after about 5 minutes. During that time the high intensity discharge bulb is rotated along the burner axis and fixed in a position where the light arc has a minimum curvature or maximum bending radius. Now the high intensity discharge bulb is placed along an optical bench in front of the high dynamic range CCD sensor chip in such a way that the light arc forms a sharp image on the camera chip, preferable at the center of the camera chip. For example, if the camera objective has a focal length of 100 mm the distance between light source and surface of the CCD-chip should be about 585.5 cm. Utilizing the LMK2000 software the image can be displayed in live mode on the a computer monitor. In order not to crossfade the CCD camera chip a $10^{-4}$% gray filter has to be mounted in front of the camera optics and a corresponding calibration factor has to be chosen within the LMK2000 program. Additionally the maximum illumination time of the CCD-chip has to be set to a value between 10 ms and 50 ms. Now the high-dynamic range measurement can be started utilizing the high dynamic range or multi-picture measurement algorithm of the LMK2000 software. According to the preferred embodiment as presented in FIGS. 4 and 5, the arc-luminescence profile of Luminescence (measured in cd/m$^2$)/mm along section 50A of the axis 50 should be at least ≧0.05 mm and ≦0.5 mm, and the slope in Luminescence/mm for that section should be ≧|300,000,000| (cd/m$^2$)/mm.

The invention claimed is:

1. A lamp configured to contain ≦100 ppm Hg, comprising:

a burner chamber having an axis, said axis having a section ≧0.05 mm, said lamp configured for producing a light arc in said burner chamber, said burner chamber configured to have a recess oriented toward the produced light arc, said lamp having an arc-luminescence profile of luminescence (measured in cd/m$^2$)/mm with an average slope over said section that is ≧|300,000,000| (cd/m$^2$)/mm.

2. The lamp according to claim 1, wherein said section is ≧0.1 mm.

3. The lamp according to claim 1, wherein, said average slope is ≧|325,000,000| (cd/m$^2$)/mm.

4. The lamp according to claim 1, configured such that said profile has a maximum value ≧90,000,000 cd/m$^2$.

5. The lamp according to claim 1, configured to have in a reflective headlight an illuminance ≧13 lux at 75L and/or 75R, and/or an illuminance ≧20 lux at 50L and/or 50R and/or an illuminance ≧16 lux at 50V, in accordance with definitions of 75L, 75R, 50L, 50R and 50V in DIN R98 of the United Nations Economic Commission for Europe (UNECE) 1958 Agreement Concerning the Adoption of Uniform Technical Prescriptions.

6. The lamp according o claim 1, configured to have in a projective headlight an illuminance ≧19 lux at 75L and/or 75R and/or an illuminance ≧21.8 lux at 50L and/or 50R and/or an illuminance ≧14 lux at 50V, in accordance with definitions of 75L, 75R, 50L, 50R and 50V in DIN R98 of the United Nations Economic Commission for Europe (UNECE) 1958 Agreement Concerning the Adoption of Uniform Technical Prescriptions.

7. The lamp according to claim 1, configured to have an arc curvature with a curvature calculable by dividing straight-line lateral extension of said light arc by straight-line longitudinal length of said light arc, the calculable curvature being ≦25%.

8. The lamp according to claim 1, said lamp comprising a high intensity discharge (HID) lamp.

9. The lamp according to claim 1, characterized in that the lamp is a quartz lamp.

10. A lamp according to claim 1, being designed for the usage in one of the following applications:

shop lighting,
home lighting,
head lamps,
accent lighting,
spot lighting,
theater lighting,
consumer TV applications,
fiber-optics applications,
car lighting, and projection systems.

11. The lamp according to claim 1, further comprising a pair of electrodes disposed for said producing of said light arc across said pair, depth of said recess being sufficiently small that said recess does not extend between said pair.

12. The lamp according to claim 1, wherein said recess has a spherical or cylindrical shape.

13. The lamp according to claim 1, wherein said recess has a radius larger than 1 mm.

14. The lamp according to claim 1, configured to contain ≦50 ppm Hg.

15. The lamp according to claim 1, configured so that any such said section is ≦0.5 mm.

16. The lamp according to claim 2, wherein said section is ≧0.2 mm.

17. The lamp according to claim 3, wherein said average slope is ≧|400,000,0001| (cd/$m^2$)/mm.

18. The lamp according to claim 1, wherein said recess is formed symmetrically with respect of said axis.

19. The lamp according to claim 4, wherein said maximum value is ≧115,000,000 cd/$m^2$.

20. A method for making a lamp configured to contain ≦100 ppm Hg, comprising:

providing a burner chamber having an axis, said axis having a section ≧0.05 mm; and forming, in said burner chamber, a recess toward where a light arc is producible in said burning chamber, said lamp having an arc-luminescence profile of luminescence (measured in cd/$m^2$)/mm with an average slope over said section that is ≧|300,000,000| (cd/$m^2$)/mm.

21. The method of claim 20, said forming comprising forming said recess so as to suppress curvature of said light arc.

22. The method of claim 20, said forming comprising forming said recess with a depth that reaches said light arc.

23. The lamp of claim 1, said recess being oriented toward the produced light arc to suppress curvature of said light arc.

24. The lamp of claim 1, said recess having a depth that reaches said light arc.

* * * * *